US007039996B2

(12) United States Patent
Crawley

(10) Patent No.: US 7,039,996 B2
(45) Date of Patent: May 9, 2006

(54) METHOD AND APPARATUS FOR REPLACING GRIPPING MEMBER ON WIRE BUCKET HANDLE

(76) Inventor: Timothy M. Crawley, 5822 W. Purdue Ave., Glendale, AZ (US) 85302

( * ) Notice: Subject to any disclaimer, the term of this patent is extended or adjusted under 35 U.S.C. 154(b) by 71 days.

(21) Appl. No.: 10/797,766

(22) Filed: Mar. 10, 2004

(65) Prior Publication Data

US 2004/0244169 A1 Dec. 9, 2004

Related U.S. Application Data

(63) Continuation-in-part of application No. 10/038,256, filed on Oct. 29, 2001, now abandoned.

(51) Int. Cl.
*B23P 6/00* (2006.01)
*B65D 25/28* (2006.01)

(52) U.S. Cl. ..... 29/402.01; 29/402.03; 29/402.08; 29/453; 220/752; 220/759; 220/768; 220/769; 16/425

(58) Field of Classification Search ..... 29/401.1, 29/402.01, 402.03, 402.08, 453, 768, 769, 29/772; 220/752, 755, 759, 760; 16/110.1, 16/425, 430

See application file for complete search history.

(56) References Cited

U.S. PATENT DOCUMENTS

| | | | | | |
|---|---|---|---|---|---|
| 614,173 | A | * | 11/1898 | Kelly | 220/755 |
| 775,662 | A | * | 11/1904 | Lyon | 220/759 |
| 1,376,126 | A | * | 4/1921 | Willett | 220/755 |
| 2,156,274 | A | * | 5/1939 | Brown | 217/125 |
| 2,319,147 | A | * | 5/1943 | Mason | 220/759 |
| 2,371,639 | A | * | 3/1945 | Mason | 220/759 |
| RE22,749 | E | * | 4/1946 | Mason | 220/759 |
| 2,398,436 | A | * | 4/1946 | Mason | 220/752 |
| 2,488,309 | A | * | 11/1949 | Mason | 220/759 |
| 3,115,229 | A | * | 12/1963 | Erhard | 220/762 |
| 4,823,433 | A | * | 4/1989 | Curtis | 220/756 |
| 5,287,991 | A | * | 2/1994 | Koda et al. | 220/769 |

* cited by examiner

*Primary Examiner*—Marc Jimenez
*Assistant Examiner*—Jermie E. Cozart
(74) *Attorney, Agent, or Firm*—Tod R. Nissle, P.C.

(57) ABSTRACT

An apparatus and method for replacing the gripping member of the handle of a bucket. The replacement gripping member includes a plurality of interfitting pieces which can be installed on the handle of a bucket without requiring that the handle be removed from the bucket.

2 Claims, 7 Drawing Sheets

FIG.6
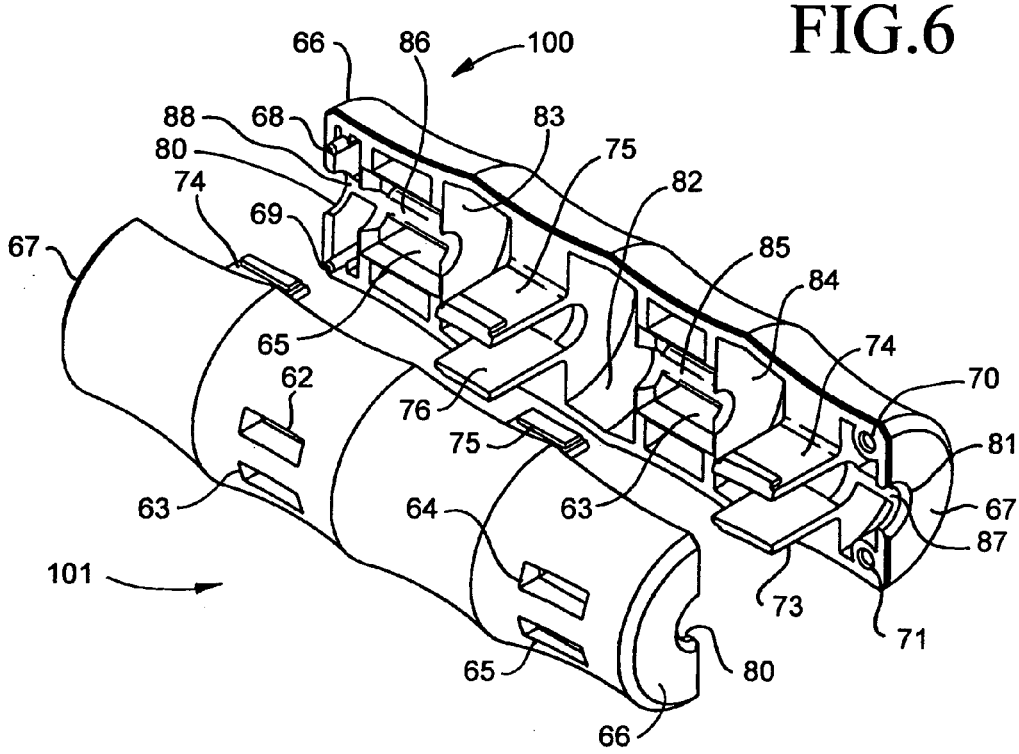
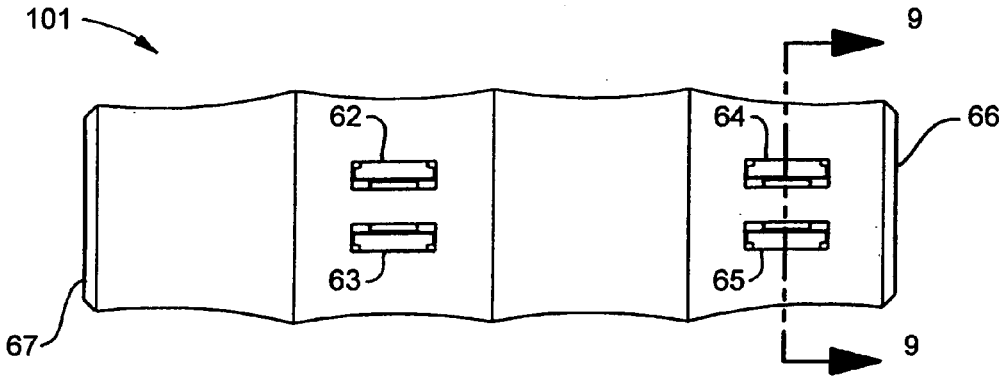
FIG.7

FIG.8
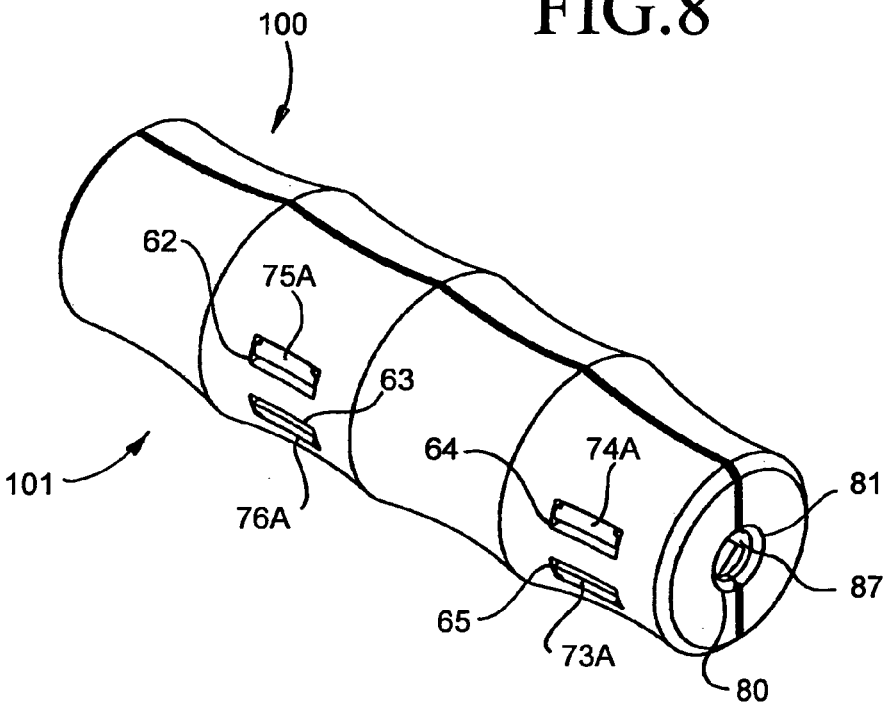
FIG.9
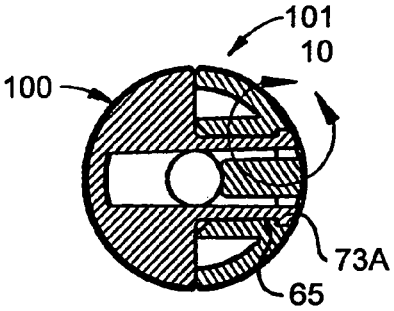
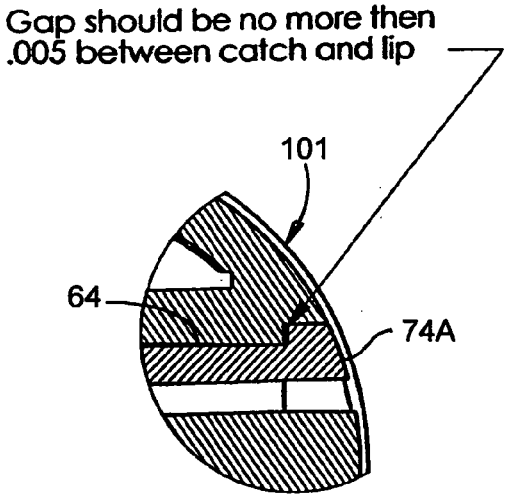
FIG.10

FIG. 13
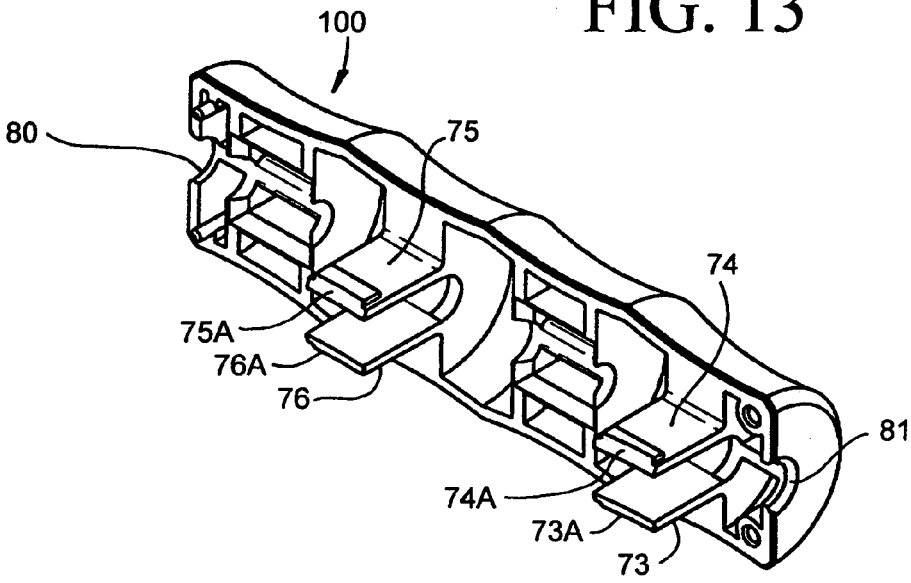
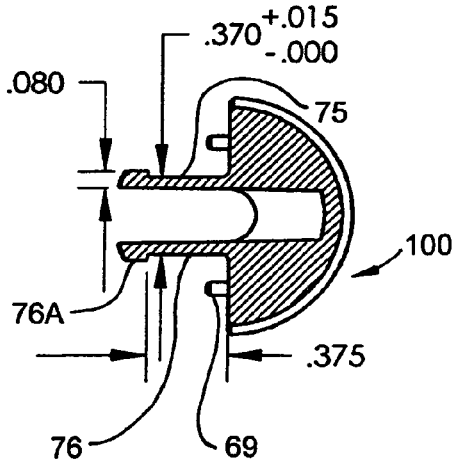
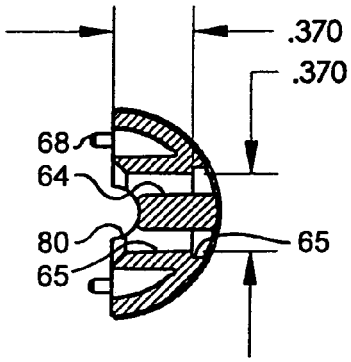
FIG. 14
FIG. 15

METHOD AND APPARATUS FOR REPLACING GRIPPING MEMBER ON WIRE BUCKET HANDLE

This application is a continuation-in-part of application Ser. No. 10/038,256, filed Oct. 29, 2001 which is now abandoned.

This invention pertains to buckets.

More particularly, this invention pertains to a method and apparatus for replacing the damaged or degraded handle on a bucket.

Cylindrical buckets which hold five gallons of paint, acrylic coating, or other liquids are well known and widely used. The cylindrical container portion of the bucket is usually fabricated from plastic, while the handle includes two parts. The first part comprises an elongate metal wire or arm having a diameter of about one-eighth of an inch. The metal arm is bent into a generally semi-circular shape. The ends of the arm are bent to engage portions of the top of the cylindrical container. The arm also include a central section intermediate the ends of the arm. The second part of the handle is a cylindrical gripping member which rotatably fits on the central section of the arm and which is shaped to comfortably contour to the hand of a user. The cylindrical gripping member is typically made from plastic and includes a honeycomb interior. The plastic comprising the gripping member degrades and breaks, especially when subjected to sunlight. After the gripping member breaks, the bucket is often discarded because a new gripping member is not readily available.

Accordingly, it would be highly desirable to provide an improved method and apparatus for replacing the gripping member on a bucket.

Therefore, it is a principal object of the invention to provide an improved method and apparatus for retrofitting the handle of a bucket with a new gripping member.

Another object of the invention is to provide an improved method and apparatus for retrofitting the semi-circular wire arm of a five gallon bucket with a new gripping member without requiring that the arm be removed from the bucket.

A further object of the invention is to provide an improved method and apparatus for reducing the quantity of buckets which are, even though the container is in good condition and can be used for an extended period of time, discarded because the gripping member is damaged or missing.

These and other, further and more specific objects and advantages of the invention will be apparent to those skilled in the art from the following detailed description thereof, taken in conjunction with the drawings, in which:

FIG. 6 is an exploded perspective view illustrating a gripping member constructed in accordance with an alternate embodiment of the invention;

FIG. 7 is a front view illustrating the gripping member of FIG. 6 assembled in the configuration of FIG. 8;

FIG. 8 is a perspective view illustrating the gripping member of FIG. 6 assembled in the configuration in which the gripping member is mounted on the handle of a bucket;

FIG. 9 is a section view illustrating the gripping member of FIG. 7 taken along section line 9—9 thereof and illustrating construction details thereof;

FIG. 10 is an enlarged view of a portion of the gripping members of FIG. 9 illustrating details thereof;

FIG. 13 is a perspective view illustrating the piece of the gripping member depicted in FIG. 11;

FIG. 14 is a section view of the piece of the gripping member depicted in FIG. 12 and taken along section line 14—14 thereof; and, FIG. 15 is a section view further illustrating the piece of the gripping member depicted in FIG. 12 and taken along section line 15—15 thereof.

Figure 1:
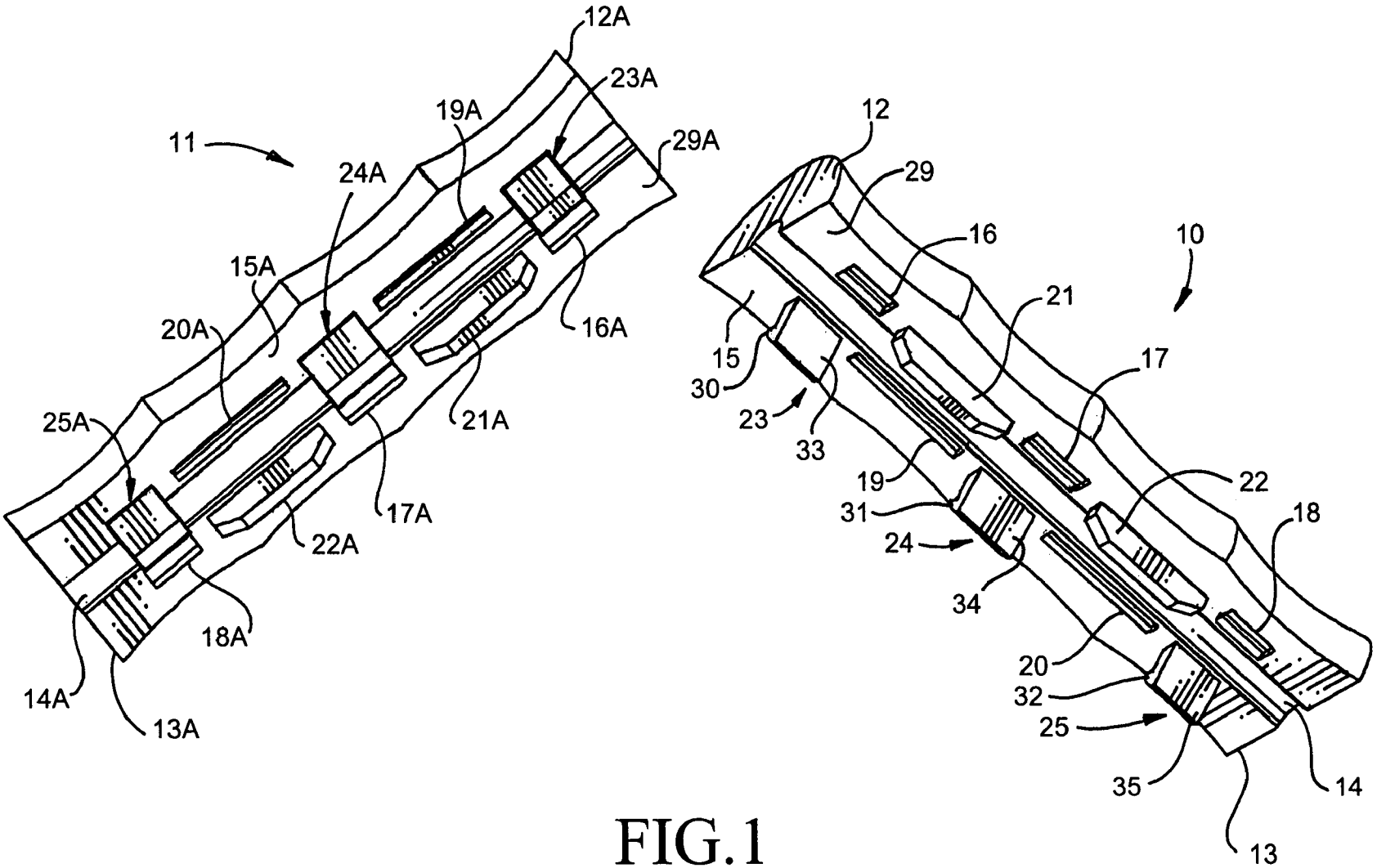
FIG. 1 is a perspective view illustrating a pair of opposing halves of a gripping member constructed in accordance with the principles of the invention.

Briefly, in accordance with the invention, I provide an improved method for retrofitting a bucket. The bucket includes a cylindrically shaped container including an upper portion, and a wire member. The wire member includes first and second ends attached to the upper portion of the container; a central section intermediate the first and second ends; and, a gripping member mounted on the central section of the wire member. The improved method includes the steps of removing the gripping member; and, providing a replacement unit for the gripping member. The replacement unit includes a plurality of pieces shaped and dimensioned to interfit with one another and circumscribe the central section of the wire member. The improved method also includes the step of mounting the replacement unit on the central section of the wire member by interfitting the plurality of pieces.

In another embodiment of the invention, I provide improvements in combination with a bucket. The bucket includes a cylindrically shaped container including an upper portion, and a wire member. The wire member includes first and second ends attached to the upper portion of the container; and, a central section intermediate the first and second ends. The improvements comprise apparatus for grasping the wire member and include a plurality of pieces shaped and dimensioned to interfit around the central section of the wire member.

In a further embodiment of the invention, I provide an improved method for retrofitting a bucket. The bucket includes a cylindrically shaped container including an upper portion, and a wire member. The wire member includes first and second ends attached to the upper portion of the container; a central section intermediate the first and second ends; and, a gripping member mounted on the central section of the wire member. The method includes the steps of removing the gripping member; and, providing a replacement unit for the gripping member. The replacement unit includes first and second identical pieces shaped and dimensioned to be mounted on the central section of the wire member by rotating the first piece one-hundred and eighty degrees from an initial orientation that is identical to that of the second piece; and, snapping the first piece into the second piece by moving one of the pieces in a direction of travel normal to the central section of the wire member such that the first and second pieces are mounted on and circumscribe the central section. Each of the pieces includes at least one clip tab including an outer end; at least one opening formed to receive the clip tab on the other of the pieces such that the clip tab on the other of the pieces snaps into the opening; and, an arcuate groove shaped to receive a portion of the central section of the wire member. The method also includes the step of mounting the replacement unit on the central section of the wire member by rotating the first piece one-hundred and eighty degrees from an initial orientation that is identical to that of the second piece; and, snapping the first piece into the second piece in a fixed position by moving one of the pieces in a direction of travel normal to the central section of the wire member such that the clip tab on each of the pieces each slide into one of the openings on the other of the pieces and snap into said one of the openings such that the clip tabs are spaced apart and alternate along a length of the central section such that the clip tab on the first piece extends in a first direction laterally past the central section, the clip tab on the second piece extends in a second direction opposite the first direction laterally past the cental section, and the end of the tab on the first piece is on a first side of the central section and the tab on the second piece is on a second side of the central section, the first side being opposite said second side, a portion of the central section nests in the arcuate groove, and first and second pieces circumscribe the central section.

In still another embodiment of the invention, I provide improvements in combination with a bucket. The bucket includes a cylindrically shaped container including an upper portion, and a wire member. The wire member includes first and second ends attached to the upper portion of the container; a central section intermediate the first and second ends; and, a gripping member mounted on the central section of the wire member. The improvements for provide a handle for the wire member. The improvements include first and second identical pieces shaped and dimensioned to be mounted on the central section of the wire member by rotating the first piece one-hundred and eighty degrees from an initial orientation that is identical to that of the second piece; and, snapping the first piece into the second piece by moving one of the pieces in a direction of travel normal to the central section of the wire member such that the first and second pieces are mounted on and circumscribe the central section. Each of the pieces includes at least one clip tab extending outwardly from the piece; at least one opening extending completely through the piece and formed to receive and interlock with the clip tab on the other of the pieces such that the clip tab on the other of the pieces snaps into the opening to hold the pieces fixedly together when one of the first and second pieces is displaced in the direction of travel toward the other of the first and second pieces and toward the central section of the wire member. Each piece also includes at least first and second arcuate grooves spaced apart and each shaped to receive a different portion of the central section of the wire member such that each of the different portions of the central section nests in one of the grooves; and, the arcuate grooves of the first piece alternate along the central section with the arcuate grooves of the second piece. The arcuate grooves of the first piece contacting a first side of the central section opposite a second side of the central section contacted by the arcuate grooves of the second piece.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 is an exploded view illustrating the interfitting units 10 and 11 which snap together to produce the gripping member of the invention. The shape and dimension of unit 11 is identical to that of unit 10, although this need not be the case.

Figure 2:
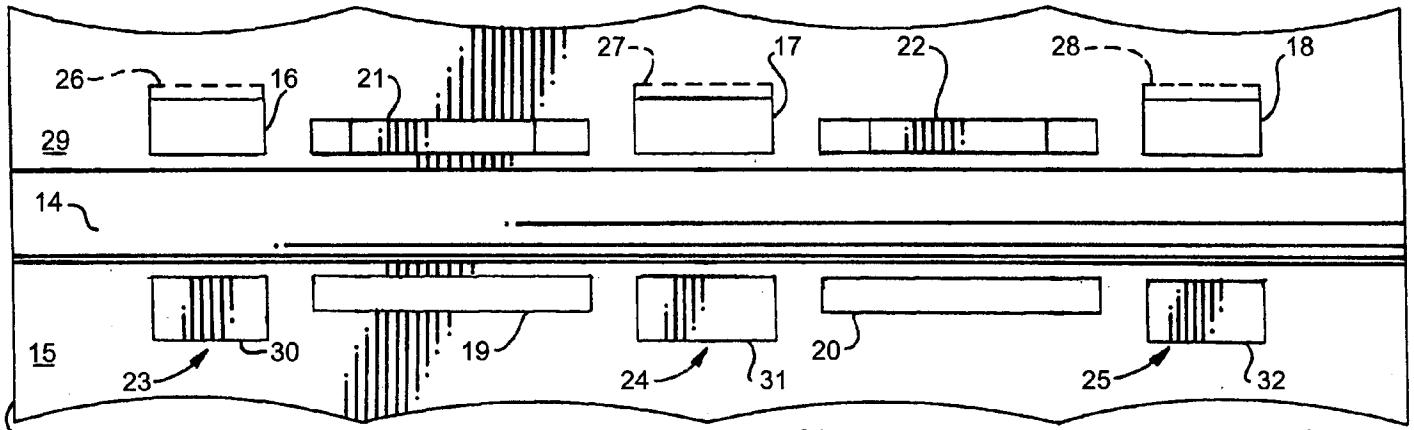
FIG. 2 is top view illustrating further construction details of one of the gripping member halves of FIG. 1.
Figure 3:
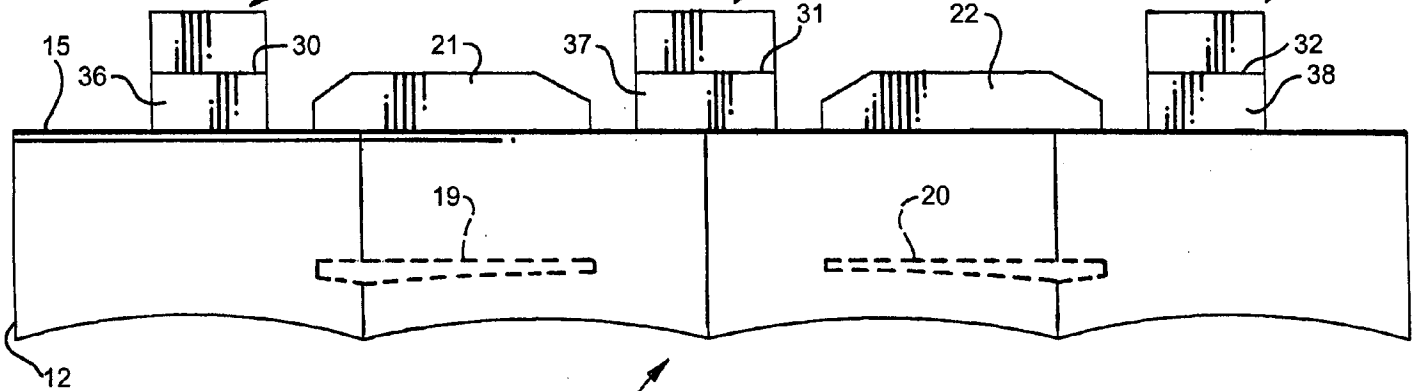
FIG. 3 is a side view illustrating the gripping member half of FIG. 2.
Figure 4:
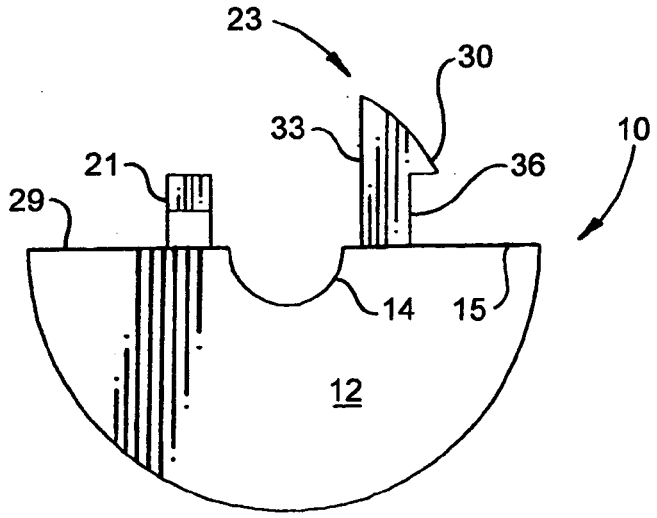
FIG. 4 is an end view illustrating the gripping member half of FIG. 3.

Unit 10 is illustrated in more detail in FIGS. 2 to 4 and includes opposed, spaced apart, parallel, semi-circular end surfaces 12, 13 and semi-cylindrical notch or groove 14 extending between end surfaces 12 and 13. Flat, co-planar surfaces 15, 29 extend outwardly from groove 14.

Notches 16, 17, 18 extend downwardly from surface 29 into unit 10. Guide tabs 21, 22 extend outwardly from surface 29. The shape and dimension of tab 21 is identical to that of tab 22.

Notches 19, 20 extend downwardly from surface 15 into unit 10. Clip tabs 23, 24, 25 extend outwardly from surface 15. Each tab 23 to 25 includes a lip 30 to 32, respectively. Tab 23 includes a back surface 33 normal to surface 15 and parallel to front surface 36 (FIG. 3). Tab 24 includes a back surface 34 normal to surface 15 and parallel to front surface 37 (FIG. 3). Tab 25 includes a back surface 35 normal to surface 15 and parallel to front surface 38 (FIG. 3). The shape and dimension of tab 23 is identical to that of each tab 24, 25.

The shape and dimension of each tab 23A to 25A of unit 11 is identical to the shape and dimension of each tab 23 to 25 of unit 10. Tab 23A includes a lip 30, back surface 33, and front surface 36; tab 24A includes a lip 31, back surface 34, and front surface 37; etc.

The shape and dimension of each tab 21A and 22A of unit 11 is identical to the shape and dimension of each tab 21, 22 of unit 10.

The shape and dimension of each notch 16A to 18A of unit 11 is identical to the shape and dimension of each notch 16 to 18 of unit 10.

The shape and dimension of each notch 19A, 20A of unit 11 is identical to the shape and dimension of each notch 19, 20 of unit 10.

Notch 16 includes a detent or lip 26 (FIG. 2). Notch 16 is shaped and dimensioned such that when clip tab 23A of unit 11 is slidably inserted in notch 16, lip 30 of tab 23A snaps into detent 26 to secure clip tab 23A in notch 16. Tab 23 of unit 10 similarly snaps into and is secured in notch 16A of unit 11.

Notch 17 includes a detent or lip 27. Notch 17 is shaped and dimensioned such that when clip tab 24A of unit 11 is slidably inserted in notch 17, lip 31 of tab 24A snaps into detent 27 to secure tab 24A in notch 17. Tab 24 of unit 10 similarly snaps into and is secured in notch 17A of unit 11.

Notch 18 includes a detent or lip 28. Notch 18 is shaped and dimensioned such that when clip tab 25A of unit 11 is slidably inserted in notch 18, lip 32 of tab 25A snaps into detent 28 to secure tab 25A in notch 18. Clip tab 25 of unit 10 similarly snaps into and is secured in notch 18A of unit 11.

Notch 19 slidably receives guide tab 21A of unit 11. Notch 19A of unit 11 slidably receives guide tab 21 of unit 10.

Notch 20 of unit 10 slidably receives guide tab 22A of unit 11. Notch 20A of unit 11 slidably receives guide tab 22 of unit 10.

Each notch 19, 20 can extend partially or completely through unit 10. In FIG. 3, dashed lines 19, 20 indicate the appearance of unit 10 when notches 19 and 20 extend completely through unit 10.

The shape and dimension of notch 16 is identical to that of notches 17 and 18. The shape and dimension of notch 19 is identical to that of notch 20.

Unit 11 includes end surfaces 12A and 13A.

Figure 5:
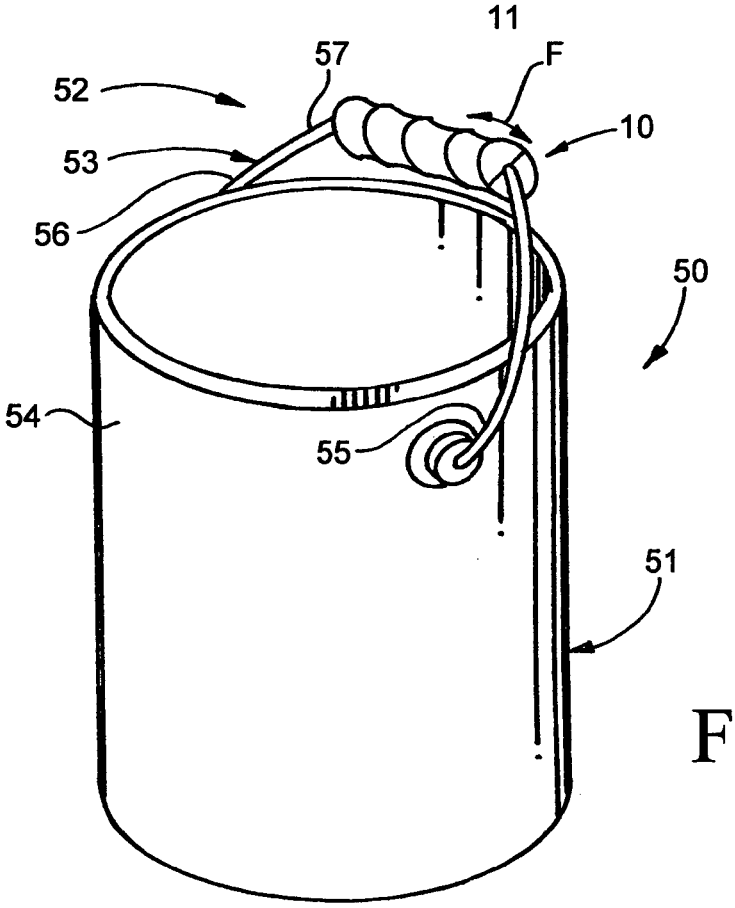
FIG. 5 is a perspective view of a bucket illustrating the gripping member of the invention installed thereon.
Figure 11:
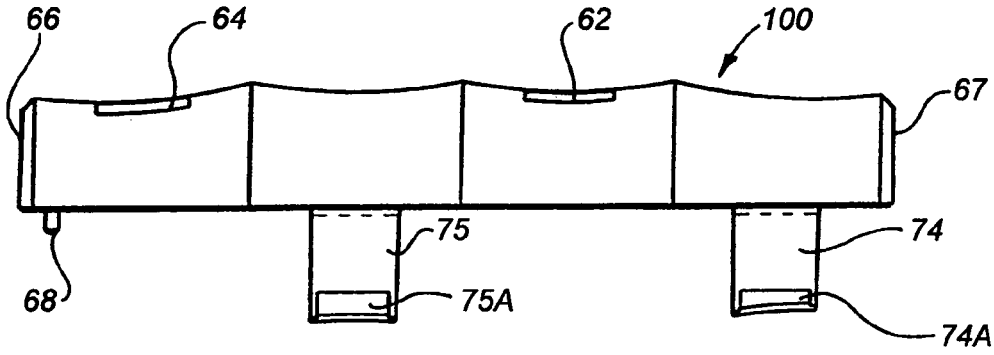
FIG. 11 is a side elevation view illustrating one of the pieces of the gripping member of FIG. 6.
Figure 12:
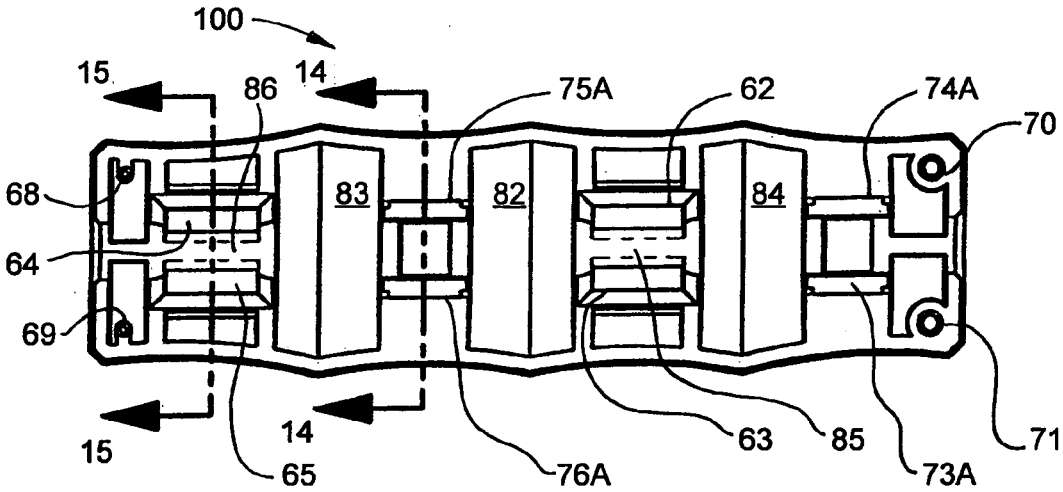
FIG. 12 is a top view illustrating the piece of the gripping member shown in FIG. 11.

In FIG. 5, bucket 50 includes cylindrical container 51 and handle 52. Handle 52 includes semi-circular wire member 53 and a gripping member including units 10 and 11. Wire member 53 includes ends 55 and 56 pivotally connected to the top portion 54 of container 51. Member 53 also includes a central portion 57 intermediate ends 55 and 56. The gripping member is mounted on central portion 57.

In use, the original gripping member (not shown) is removed from the central portion of wire member 53. The gripping member of the invention is mounted on the central portion of wire member 53 by snapping together units 10 and 11 such that the central portion 57 nests and rests in grooves 14, 14A. When units 10 and 11 are snapped together, grooves 14, 14A collectively form a cylindrical channel through which the central portion 57 of wire member 53 extends, preferably such that the gripping member can readily rotate around wire member 53 in the directions indicated by arrows F in FIG. 5.

As earlier described, when units 10 and 11 are snapped together on wire member 53, tabs 23 to 25 snap into notches 16A to 18A, respectively; tabs 23A to 25A snap into notches 16 to 18, respectively; guide tabs 21A, 22A slide into notches 19 and 20, respectively; guide tabs 21, 22 slide into notches 19A and 20A, respectively; surface 15A is parallel to and contacts surface 29; and surface 29A is parallel to and contacts surface 15. The number of tabs and/or notches can vary as desired. The combination of clip tabs and guide tabs is preferred in the practice of the invention because it facilitates a secure interfitting of units 10 and 11.

FIGS. 6 to 15 illustrate an alternate embodiment of the invention including first and second identical pieces 100 and 101. Since pieces 100 and 101 are identical, the reference characters utilized to identify portions of piece 100 are identical to the reference characters utilized to identify like portions of piece 101.

Piece 100 (and piece 101) includes ends 66 and 67; semi-circular aperture 81 in end 67; semi-circular aperture 80 in end 66; slots 62 to 65; semi-circular grooves 82, 83, 84; resilient snap tabs 73 to 76 with toothed tips 73A to 76A, respectively, that are shaped and dimensioned to snap into and interlock with slots 65, 64, 62, 63, respectively, in a piece 101 in the manner illustrated in FIG. 8; cylindrical apertures 70 and 71; cylindrical guides 68 and 69 sized to slidably fit in apertures 70 and 71 in a piece 101 that is placed adjacent piece 100 in the manner illustrated in FIG. 8; and, arcuate wire-handle-support surfaces 88, 86, 85, 87 lying along and parallel to a common line.

The interlocking of snap tabs 73 and 74 with slots 65 and 64, respectively, is illustrated in greater detail in FIGS. 9, 10, 14, and 15. As shown in FIG. 10, each tab includes a tooth-shaped catch that extends over and interlocks with a lip or ledge formed in its associated slot 64.

When pieces 100 and 101 are interfit in the manner illustrated in FIG. 8 on the wire handle of a bucket with each tab 73 to 76 snapped in interlocking fashion into its associated slot 65, 64, 62, 63, respectively, the support surfaces 85 and 86 on piece 100 contact the wire handle of a bucket and alternate at spaced intervals along the wire handle with the support surfaces 85 and 86 on piece 101. In FIG. 8, support surface 87 of piece 100 is opposed to support surface 88 on piece 101; and, support surface 87 of piece 101 is opposed to support surface 88 on piece 100. Arcuate support surface 78 and 88 on each piece 100 and 101 contact the wire handle. The shape and dimension of supports surfaces 87, 88, 85, 86 can vary as desired, but said support surfaces presently are arcuate and are shaped to conform to a bucket handle that has a cylindrical cross-section.

The handle of FIGS. 6 to 15 is preferred over the handle of FIG. 1 et seq. because the FIG. 6 handle eliminates the necessity of guide tabs 21 and 22 and guide slots 19 and 20, utilizes a strong light-weight ribbed design that incorporates U-shaped semi-cylindrical openings 82, 83, 84 and requires less material, utilizes snap tab pairs at four points (instead of three) along the length of the handle, and incorporates the use of much smaller guide members 68 and 69. The handle of FIG. 6, like the handle of FIG. 1, directs the wire handle of a bucket intermediate tab pairs 75, 76 and 73, 74 when the handle of FIG. 6 is assembled on a wire bucket handle in the configuration illustrated in FIG. 8 and in the same manner that the handle of FIG. 1 is assembled on wire handle 52 in FIG. 5. The handles of FIGS. 1 and 6 each include a pair of halves, i.e., in FIG. 6 pieces 100 and 101 comprise the halves. In FIG. 1, pieces 10 and 11 comprises the halves. Each half includes male and female components. In FIG. 6 tabs 73 to 76 are the male components and slots 62 to 65 are the female components. This is believed important because the tab pairs 73, 74 and 75, 76 on one half or piece 100 function (when inserted in slots 65, 64, 62, 63, respectively) to pull the other piece 101 toward piece 100. The tab pairs 73, 74 and 75, 76 on the other half or piece 101 function (when inserted in slots 65, 64, 62, 63, respectively) to pull the other piece 100 toward piece 100. This is believed to produce a counterbalancing of forces that tends to extend the life of the handle and to reduce the likelihood that a toothed tip 73A, 74A, 75A, 76A will shear or break off.

I claim:

1. A method for retrofitting a bucket including a cylindrically shaped container including an upper portion, and a wire member including first and second ends attached to the upper portion of the container, a central section intermediate the first and second ends, and a gripping member mounted on the central section of the wire member, the method including the steps of:

(a) removing the gripping member;

(b) providing a replacement unit for the gripping member, the replacement unit including first and second identical pieces shaped and dimensioned to be mounted on the central section of the wire member by (i) rotating said first piece one-hundred and eighty degrees from an initial orientation that is identical to that of said second piece, and (ii) snapping said first piece into said second piece by moving one of said pieces in a direction of travel normal to the central section of the wire member such that said first and second pieces are mounted on and circumscribe the central section, each of said pieces including (iii) at least one clip tab including an outer end, (iv) at least one opening formed to receive said clip tab on the other of said pieces such that said clip tab on the other of said pieces snaps into said opening, and (v) an arcuate groove shaped to receive a portion of the central section of the wire member; and, (c) mounting the replacement unit on the central section of the wire member by (i) rotating said first piece one-hundred and eighty degrees from an initial orientation that is identical to that of said second piece, and (ii) snapping said first piece into said second piece in a fixed position by moving one of said pieces in a direction of travel normal to the central section of the wire member such that said clip tab on each of said pieces each slide into one of said openings on the other of said pieces and snap into said one of said openings such that said clip tabs are spaced apart and alternate along a length of said central section such that said clip tab on said first piece extends in a first direction laterally past said central section, said clip tab on said second piece extends in a second direction opposite said first direction laterally past said central section, and said end of said tab on said first piece is on a first side of said central section and said tab on said second piece is on a second side of said central section, said first side being opposite said second side, a portion of the central section nests in said arcuate groove, and said first and second pieces circumscribe the central section.

2. In combination with a bucket, the bucket including a cylindrically shaped container including an upper portion, and a wire member including first and second ends attached to the upper portion of the container, a central section intermediate the first and second ends, and a gripping member mounted on the central section of the wire member, the improvements for providing a handle for the wire member, said improvements including first and second identical pieces shaped and dimensioned to be mounted on the central section of the wire member by (a) rotating said first piece one-hundred and eighty degrees from an initial orientation that is identical to that of said second piece; and, (b) snapping said first piece into said second piece by moving one of said pieces in a direction of travel normal to the central section of the wire member such that said first and second pieces are mounted on and circumscribe the central section, each of said pieces including (c) at least one clip tab extending outwardly from said piece;

(d) at least one opening extending completely through said piece and formed to receive and interlock with said clip tab on the other of said pieces such that said clip tab on the other of said pieces snaps into said opening to hold said pieces fixedly together when one of said first and second pieces is displaced in said direction of travel toward the other of said first and second pieces and toward the central section of the wire member; and (e) at least first and second arcuate grooves spaced apart and each shaped to receive a different portion of the central section of the wire member such that (i) each of said different portions of the central section nests in one of said grooves, and (ii) said arcuate grooves of said first piece alternate along the central section with said arcuate grooves of said second piece, said arcuate grooves of said first piece contacting a first side of said central section opposite a second side of said central section contacted by said arcuate grooves of said second piece.

* * * * *